United States Patent [19]

Kasher et al.

[11] Patent Number: 4,909,330

[45] Date of Patent: Mar. 20, 1990

[54] AUTOMOTIVE EARTH MOVING VEHICLE WITH SEGMENTED BLADE FOR ALTERNATING BETWEEN STRAIGHT AND ANGULAR SHAPES

[75] Inventors: Igal Kasher, Kfar Saba; Haim Ginat, Ramat Hasharon, both of Israel

[73] Assignee: The State of Israel, Ministry of Defence, Israel Military Industries, Israel

[21] Appl. No.: 941,725

[22] Filed: Dec. 12, 1986

[30] Foreign Application Priority Data

May 6, 1986 [IL] Israel ..... 78706

[51] Int. Cl.[4] ..... E02F 3/76; A01B 63/114

[52] U.S. Cl. ..... 172/4; 37/2 R; 89/1.13; 172/777; 172/815; 172/831

[58] Field of Search ..... 172/4, 4.5, 701.1, 701.2, 172/701.3, 719, 777, 815, 821, 822, 818, 819, 823, 828, 830, 831, 832; 37/117.5, 2 R; 56/10.2, DIG. 15; 89/1.13

[56] References Cited

U.S. PATENT DOCUMENTS

| | | | |
|---|---|---|---|
| 2,200,230 | 5/1940 | Hojnowski | 89/1.13 X |
| 2,486,372 | 10/1949 | Rockwell | 89/1.13 |
| 2,875,535 | 3/1959 | Williams et al. | 172/831 X |
| 3,088,264 | 5/1963 | Sallee | 172/4 X |
| 3,157,099 | 11/1964 | Ulrich | 172/815 |
| 3,246,406 | 4/1966 | Ray, Jr. | 172/822 |
| 3,515,224 | 6/1970 | Seaberg | 172/831 X |
| 3,729,844 | 5/1973 | Deglan | 37/117.5 |
| 4,166,506 | 9/1979 | Tezuka et al. | 172/4.5 |
| 4,249,323 | 2/1981 | Mathis et al. | 172/815 X |
| 4,306,625 | 12/1981 | Davis | 172/701.1 X |
| 4,311,200 | 1/1982 | Lebedev et al. | 172/815 X |
| 4,467,694 | 8/1984 | Azulai et al. | 89/1.13 |
| 4,573,124 | 2/1986 | Seiferling | 56/DIG. 15 X |
| 4,727,940 | 3/1988 | Bar-Nefy et al. | 172/4 X |

FOREIGN PATENT DOCUMENTS

| | | | |
|---|---|---|---|
| 627220 | 9/1978 | U.S.S.R. | 172/701.1 |

*Primary Examiner*—Richard T. Stouffer

*Attorney, Agent, or Firm*—Steinberg & Raskin

[57] ABSTRACT

An automotive earth moving vehicle for civil and military applications. The blade is movable with respect to the body by two independently operable sets of fluid driven actuator sets which are in intersecting spatial relationship. Each actuator set is arranged symmetrically with respect to a vertical median plane of the blade and its actuators are in parallel spatial orientation with respect to each other. One set of actuators is designed for lifting and lowering the blade while the other set is designed to bring about oscillation and tilt. The blade comprises two segments horizontally linked to each other and is thus adapted to alternate between a dozer mode and a plough mode. Wing members may be provided for attachment to the two flanks of the blade in the plough mode.

The vehicle also comprises a sensor for use in the plough mode adapted to feed the blade movement control with data on the terrain.

18 Claims, 8 Drawing Sheets

AUTOMOTIVE EARTH MOVING VEHICLE WITH SEGMENTED BLADE FOR ALTERNATING BETWEEN STRAIGHT AND ANGULAR SHAPES

BACKGROUND OF THE INVENTION

The present invention concerns self-propelled earth moving equipment, e.g. of the dozer or plough type, that can be used in road building, farming, construction, wrecking and the like. Equipment of this kind comprises an automotive vehicle of the crawler, caterpillar or of the wheel type, and at the front side a working tool. The working tool of equipment of the kind specified will be referred to hereinafter for short as "blade". Furthermore, wherever hereinafter there is reference to the "front side" or simply "front" of an earth moving vehicle according to the invention, this means the end side that bears the blade, it being understood that in the non-operative state when the blade is idle the vehicle may be designed for driving in the opposite direction, i.e. with the blade at the rear.

In known earth moving equipment of the kind specified, the blade is as a rule designed for elevation and tilt only, i.e. for a movement by which it can be lifted or lowered and tilted according to need. In some known equipment the blade may also be made to change its angular position with respect to the vehicle. As the applications of earth moving vehicles of the kind specified have become more diversified, the need has arisen for greater versatility of the blade movements, e.g. the ability also to oscillate.

SUMMARY OF THE INVENTION

It is accordingly the object of the present invention to provide an improved earth moving vehicle of the kind specified in which the blade can be oscillated in addition to being elevated and tilted.

In accordance with the present invention there is provided an automotive earth moving vehicle comprising a body and a working blade mounted at the front side of the body on push beams articulated to the body so as to be swingable vertically, which blade is adapted for controlled movement with respect to the body, characterized in that the blade is movable with respect to the body by means of two independently operable sets of fluid driven (hydraulic) actuators each of which set comprises an even number of actuators arranged symmetrically with respect to a vertical median plane of the blade, the actuators of each set being of parallel spatial orientation while with respect to each other the, two sets are in intersecting spatial relationship which relationship is maintained at all operational positions of the blade, one set of actuators being designed for lifting and lowering the blade (elevation actuators) while the other set is designed to bring about oscillation and tilt of the blade (angular displacement actuators).

In many cases it is sufficient that each set comprises only two actuators but in cases of heavy duty there may be four or even more actuators in a set. Moreover it is possible that the number of actuators in the two sets be different, e.g. two actuators in one set and four in the other.

During lifting and lowering of the blade the actuators set are active while the angular displacement actuators are passive, the active activators always moving codirectionally pulling the blade for lifting and pushing it for lowering.

During oscillation of the blade the angular displacement actuators are active while the elevation actuators are passive, the active actuators moving again codirectionally pushing or pulling the blade according to the desired sense of oscillation.

During tilting of the blade as well, the angular displacement actuators are active while the elevation actuators are passive. However, in this case the actuators on the two sides of the median plane of the blade move in opposite directions pulling on one side and pushing on the other side.

The term "active" used herein with respect to actuators means that the actuators concerned act as prime movers while the term "passive" denotes that the actuators concerned do either not move at all or move solely by being dragged by the action of the active actuators.

In the foregoing description the three possible movements, to wit elevation, tilt and oscillation are described separately. It is, however, possible, in accordance with the invention, to combine and effect simultaneously two or even all three of these movements. Where oscillation and tilt are effected simultaneously, the angular displacement actuators will operate codirectionally, i.e. both of them will pull and push at the same time but the degree of the pull and push on both sides of the median plane will be different.

There are cases where it is desirable that the blade be designed for dual purpose application, i.e. to serve as an ordinary earth pushing blade or alternatively for earth ploughing operations such as land clearing, root ploughing or mine ploughing (a military appliction). Consequently, in accordance with one embodiment of the invention, there is provided an automotive earth moving vehicle of the kind specified, further characterized in that the blade comprises two segments hingedly linked to each other in said median plane and adapted to alternate between a straight shape (dozer mode) and an angular shape (plough mode), means being provided for securing the segments in either mode, the lower edge of said segments being fitted with teeth adapted to penetrate into the ground. In accordance with this embodiment there are preferably provided edge covers for covering the teeth from below when the blade is used in the dozer mode.

In accordance with such a dual purpose embodiment there may, if desired, be provided two wing members with teeth at their lower edges for attachment to the two flanks of the blade in the plough mode.

The above dual purpose earth moving vehicle according to the invention has been found to be particularly useful as a counter-obstacle vehicle for military application, to be used alternatively as a bulldozer or mine plough. In either of these applications the counter-obstacle vehicle has to operate in difficult terrain, and under such conditions the great versatility of the blade provided in accordance with the invention is of great advantage, both in the dozer mode and in the mine plough mode.

A dual purpose embodiment of an earth moving vehicle according to the invention may be fitted with sensor means to indicate any adjustments of the blade required to maintain a desired ploughing depth. If desired such sensor means may be combined with a closed loop servo system adapted to operate automatically the various blade movements thereby to control automatically the ploughing depth.

DESCRIPTION OF THE DRAWINGS

For better understanding some embodiments of the invention will now be specifically described with reference to the attached drawings in which.

DESCRIPTION OF A PREFERRED EMBODIMENT

Figure 1:
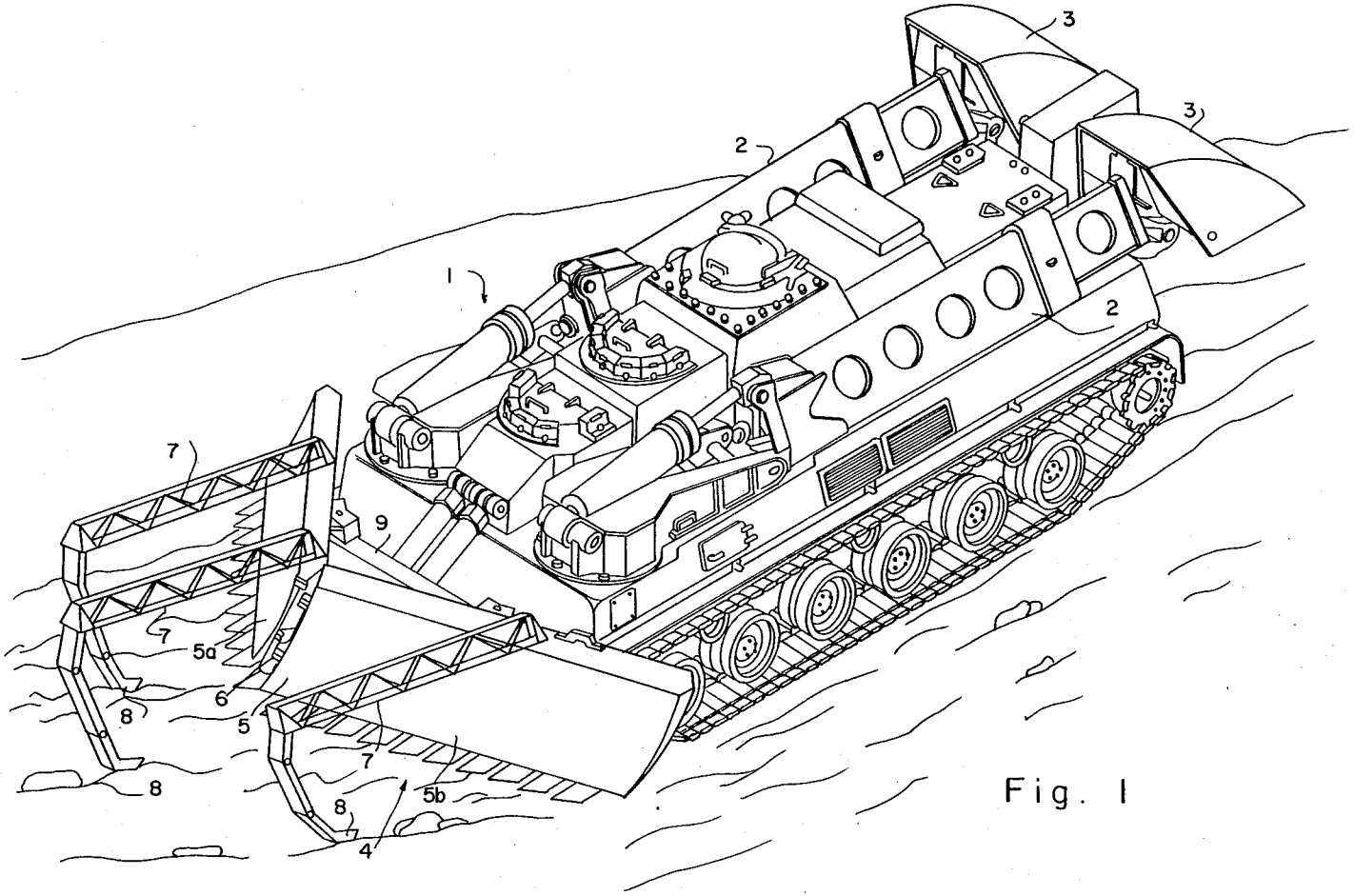
FIG. 1 is a perspective view of a counter-obstacle vehicle (COV) according to the invention in the plough mode.
Figure 2:
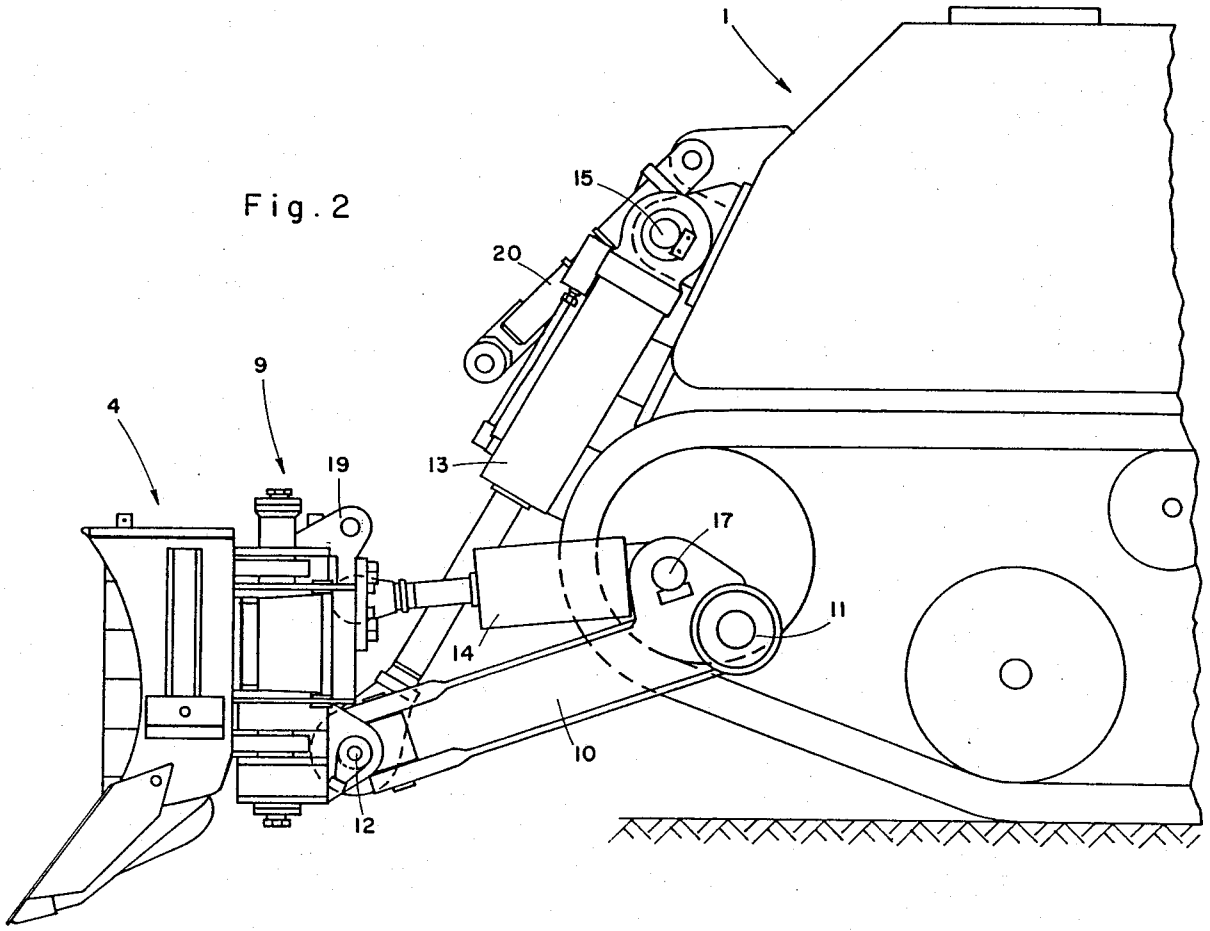
FIG. 2 is an elevation of the front section of the COV of FIG. 1 in the dozer mode and drawn to a larger scale.

The COV shown in FIG. 1 comprises a caterpillar type armoured vehicle 1 having a variety of accessories such as, for example, two telescopic arms 2 with digging buckets 3 stowed to the rear. At its front COV 1 comprises a blade 4 which is shown here in the plough mode. As can be seen, blade 4 comprises two segments 5*a* and 5*b* hinged together at 6, the hinge being located at the median vertical plane of the blade 4.

Mounted on blade 4 are three arms 7 which together with shoes 8 fitted with sensor means form a tactile tracking system which forms part of a closed loop servo control system adapted to lift or lower the blade, oscillate and tilt it in accordance with the nature of the terrain as sensed by the sensors in order to maintain automatically a desired ploughing depth.

By turning now to FIGS. 2–5 it is seen that blade 4 is fitted with an integral cross member 9 which serves for linking the blade to vehicle 1 by means of two pushbeams 10 each articulated at 11 to the vehicle and at 12 by means of a U-joint to the cross-member. One of pushbeams 10 is associated with a brace bar as will be described further below.

Blade 4 is further linked to vehicle 1 by means of two sets of two elevation actuators each. The first set comprises two actuators 13 and the second set comprises two angular displacement actuators 14 each actuator comprising a piston reciprocable within a cylinder and a piston rod emerging therefrom. It is seen that the two actuators of each set are arranged symmetrically on the two sides of the vertical median plane of blade 4. Each of actuators 13 is articulated to vehicle 1 at 15 and to cross-member 9 at 16. Each of actuators 14 is articulated to a pushbeam 10 at 17 and linked to cross-member 9 at 18.

Cross member 9 is fitted with two lugs 19 which in the inoperative state of the blade serve for suspending the blade/cross member assembly from a bracket 20 which enables to relieve pressure from the elevation actuators 13 when blade 4 is inoperative.

For further reinforcement of the blade suspension assembly there is provided a brace bar 21 articulated to a lug 22 which is pivotally connected to pushbeam 10 at 23, and articulated to cross member 9 at 24.

The two segments 5*a* and 5*b* of blade 4 are hinged together at 6 (see FIG. 1) by means of a pivot 25 engaging aligned bores of lugs of the two segments such as lugs 26 and 27 of segment 5*a* and lugs 28 and 29 of segment 5*b*. In addition there are mounted on pivot 25 housings 30 and 31 holding a central tooth (not shown).

Blade 4 is provided with a number of lugs 33, 34, 35, 36, 37 and 38 which serve for securing the blade in either the dozer mode or the plough mode. Of these lugs 33, 34, 37 and 38 are actually couples of lugs of which only the upper one is seen in the drawing, while 35 and 36 are single lugs. Thus, in the dozer mode lugs 34, 35, 36 and 37 cooperate with brackets of the cross member and lugs 33 and 38 are linked to legs 39 and 40 by means of links 41*a* and 41*b*, all in the manner shown in FIG. 3 while in the plough mode lugs 33 and 38 engage the cross member 9 in the manner shown in FIG. 5.

Figure 3:
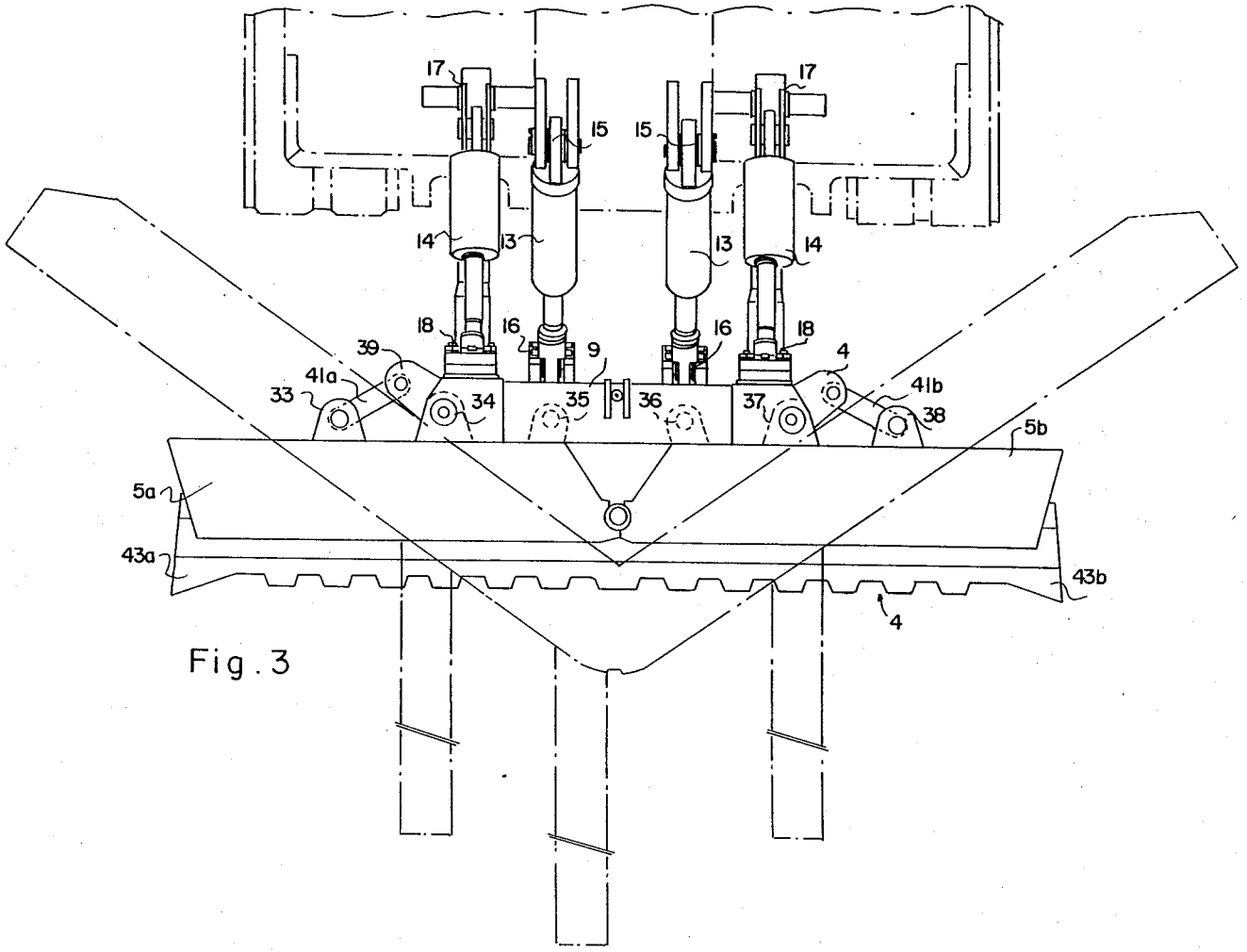
FIG. 3 is a plan view of the front section of the COV of FIG. 1 drawn to a larger scale and showing the blade in the dozer mode.
Figure 4:
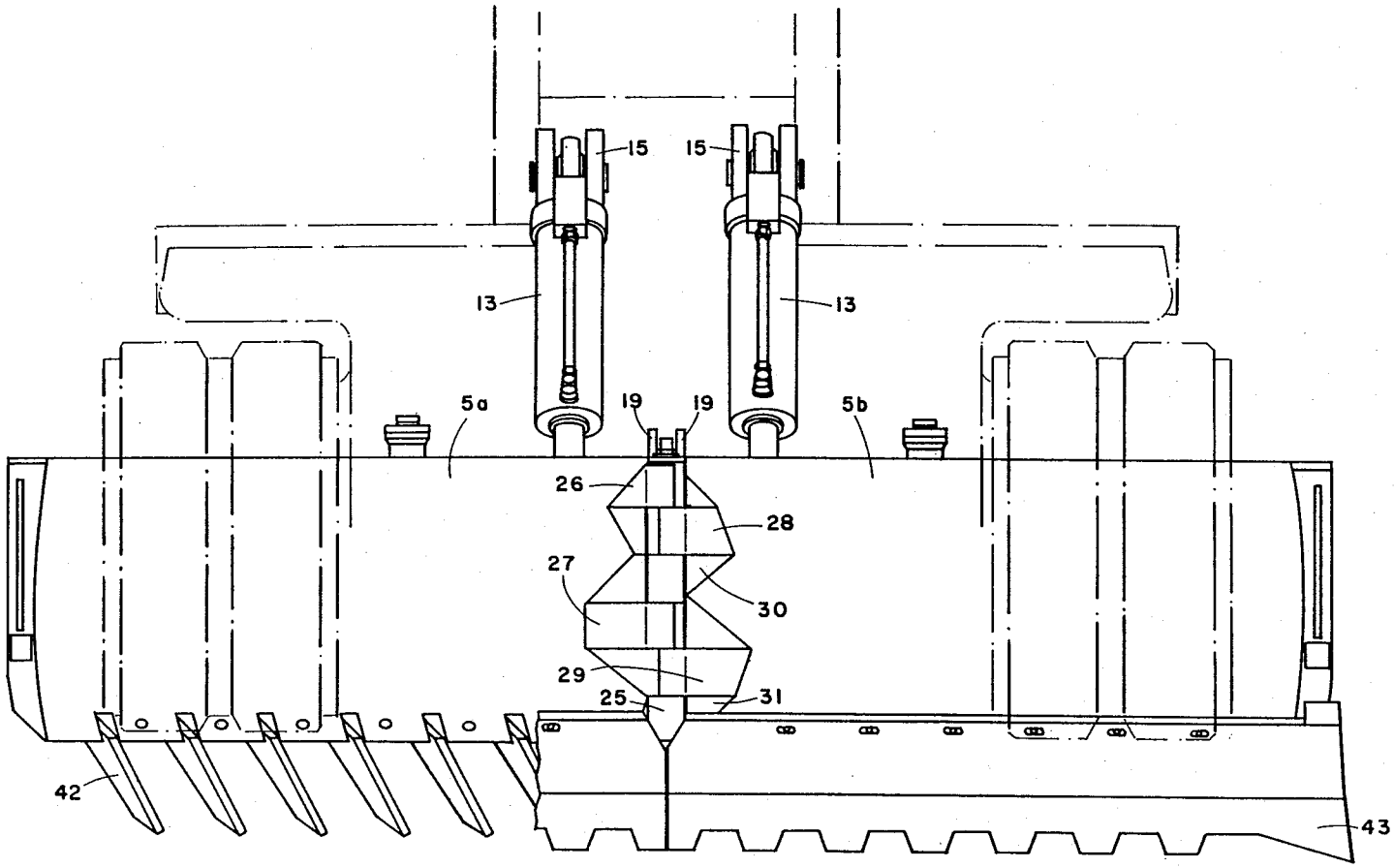
FIG. 4 is a front elevation of the COV of FIG. 1 drawn to a larger scale and showing the blade in the dozer mode.
Figure 5:
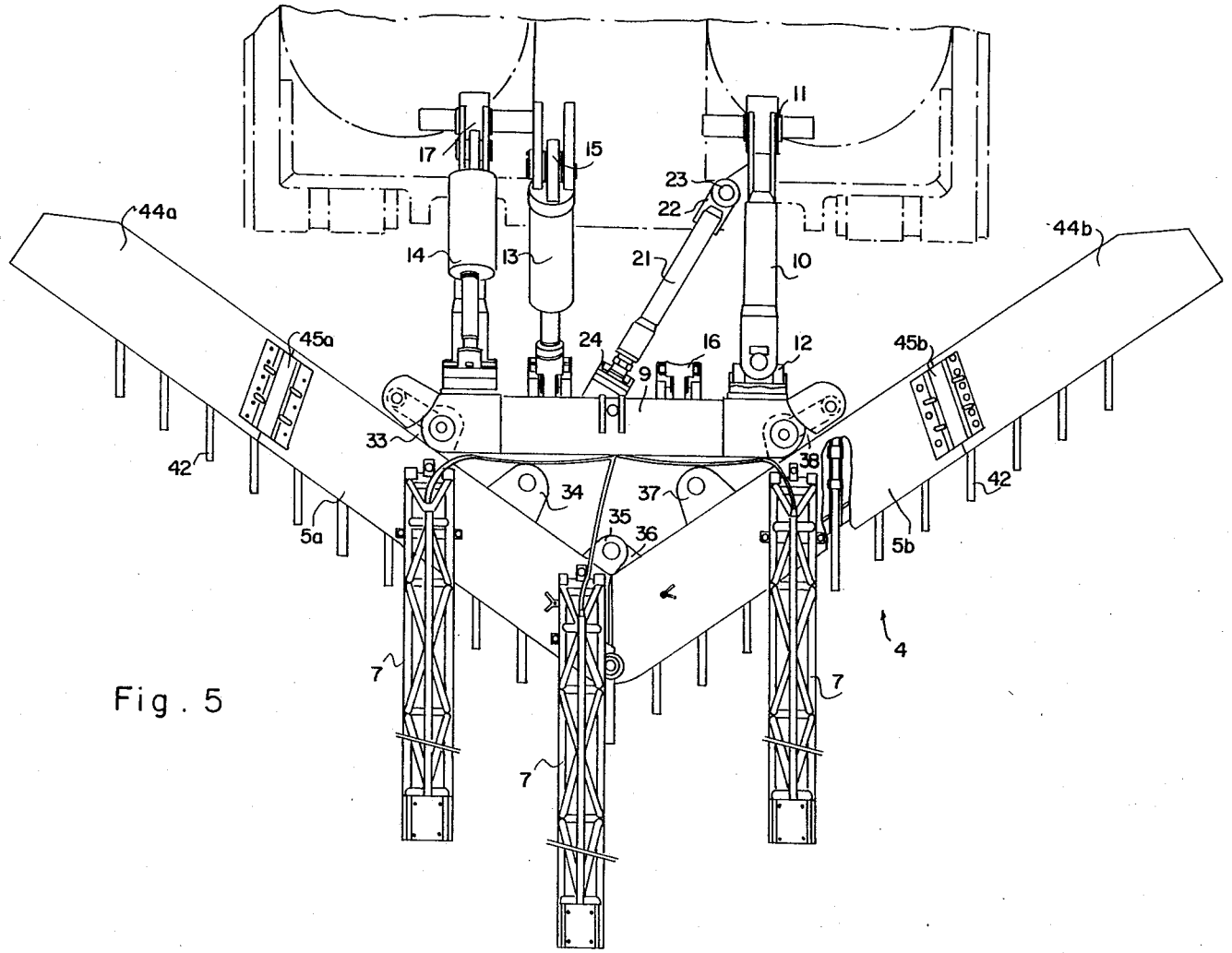
FIG. 5 is a plan view of the front section of the COV of FIG. 1 drawn to a larger scale with two actuators removed, showing the blade in the plough mode and also showing arms of a tracking system for automatic depth control.

At its lower edge blade 4 comprises a plurality of ploughing teeth 42 which are exposed in the plough mode shown in FIG. 5 and which in the dozer mode are covered by edge guards 43*a* and 43*b* as shown in FIGS. 3 and 4. (in FIG. 4 part of edge guard 43 is broken away.)

In the plough mode of FIG. 5 wings 44*a* and 44*b* are attached to the blade so as to flank, respectively, segments 5*a* and 5*b*, the attachment being by means of connector pieces 45*a* and 45*b*.

Figure 8:
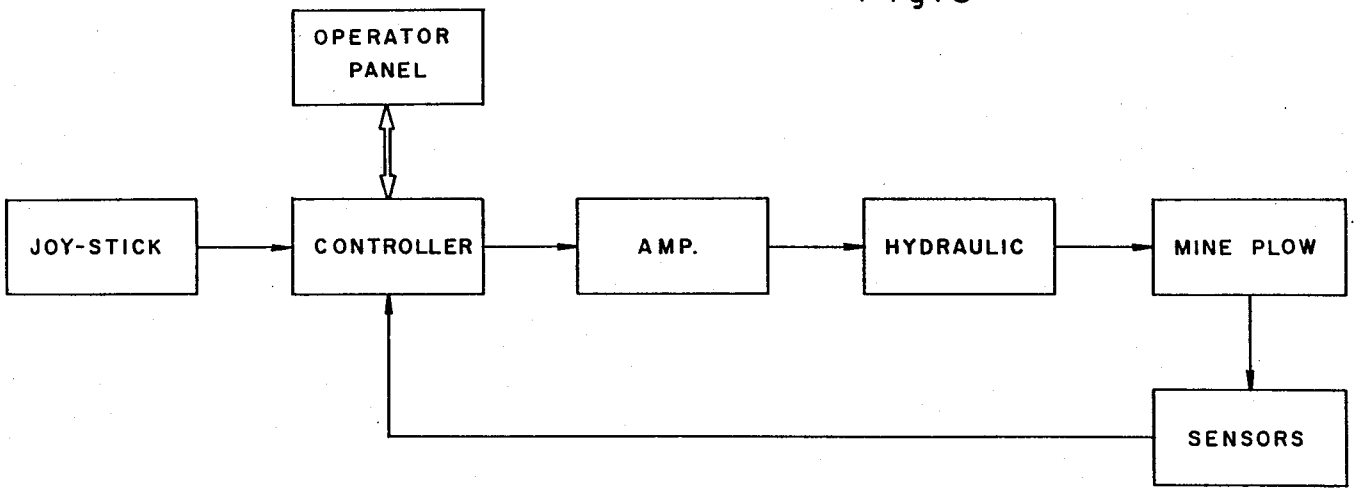
FIG. 8 is a block diagram of the automatic depth control system of a COV according to FIG. 1.

Arms 7 together with sensor shoes 8 form a tactile tracking arrangement which is designed to feed the blade movement control with data on the terrain. If desired, arms 7 with sensor shoes 8 may form part of a closed loop servo system for the automatic depth control of teeth 42 during a mine ploughing operation. A block diagram of such a system is shown in FIG. 8 and it comprises sensors which feed a controller that in turn feeds an amplifier which operates the hydraulic system that actuates the mine plough. The controller is linked to an operator panel and the operator may optionally manipulate a joystick in order to intervene in the manipulation of the blade. Instead of tactile sensors it is also possible to use ultrasonic sensors.

Figure 6B:
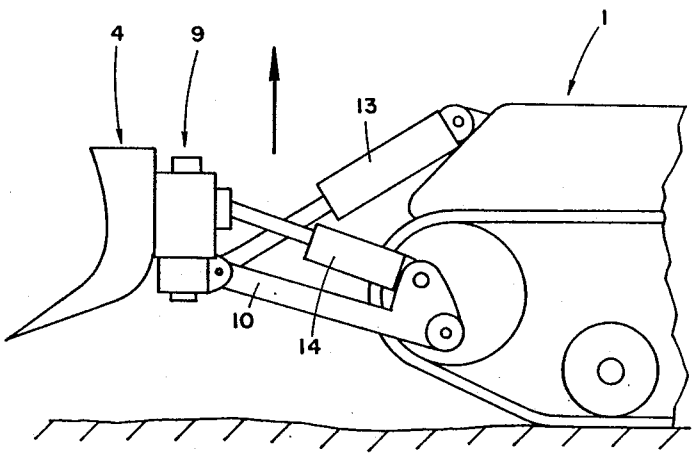
FIGS. 6*a*, 6*b*, and 6*c* show shows diagrammatically the front section of the COV of FIG. 1 in three operational positions to illustrate the elevation and oscillation of the blade.
Figure 6A:
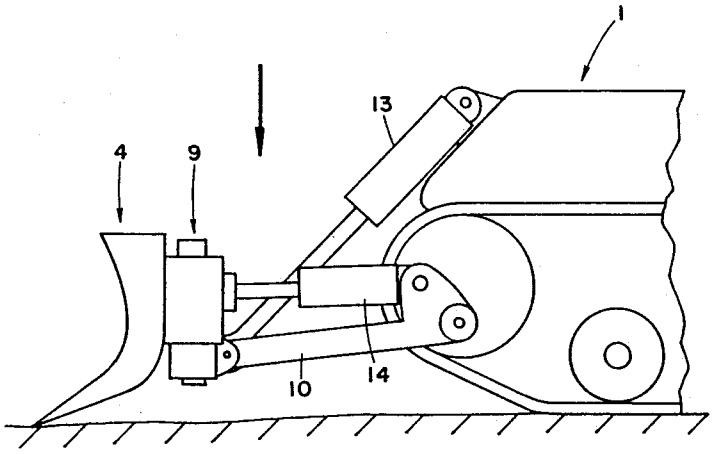

The elevation and oscillation manipulation of blade 4 are shown in FIG. 6. By referring first to FIG. 6*a* it is seen that the blade 4 is in a low position in which the lower edge touches the ground. From that position the blade may be lifted as shown in FIG. 6*b* by a pulling operation of actuators 13 during which the piston rods thereof are withdrawn into the cylinder. During this operation pushbeams 10 and actuators 14 change their angular positions. It should be noted, however, that actuators 14 remain passive and are merely drawn by actuators 13 which are the prime movers during the lifting and lowering of blade 4. It should also be noted that although the angular position of actuators 14 change during the lift, actuators 13 and 14 still remain in intersecting spatial relationship.

Figure 6C:
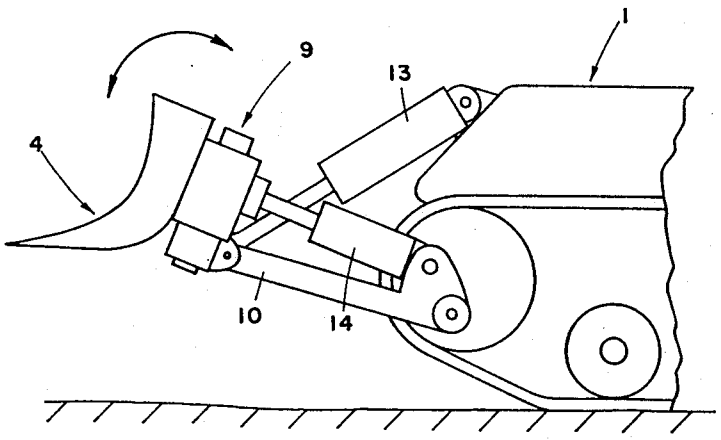

FIG. 6*c* illustrates the oscillation of blade 4. The oscillation is arbitrarily shown in the elevational position of blade 4 of FIG. *6b* but is clearly independent of the level of blade 4 and can be effected in any level of the blade, independent of any elevation operation. It is seen that blade 4 can be oscillated clockwise or anti-clockwise by the action of actuators 14 which for a clockwise movement exert a pull during which the piston rods are withdrawn into the cylinder while for an anti-clockwise movement the actuators 14 form a pushing movement during which the piston rods are pushed out from the cylinders. During the oscillations actuators 13 remain passive and blade 4 turns around the joints at which the pushbeam 10 and actuators 13 are articulated to the cross-member 9.

Figure 7A:
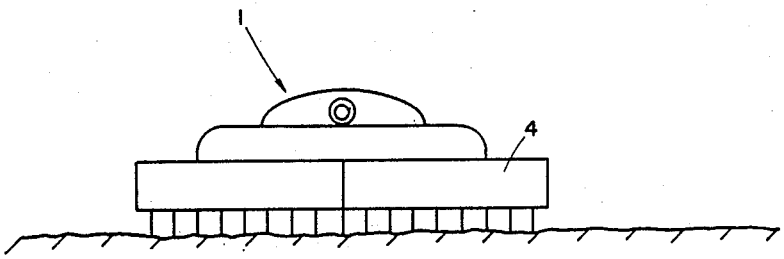
FIGS. 7*a*, 7*b*, and 7*c* show diagrammatically front elevations of the COV of FIG. 1 in three different positions to illustrate the tilt of the blade.
Figure 7B:
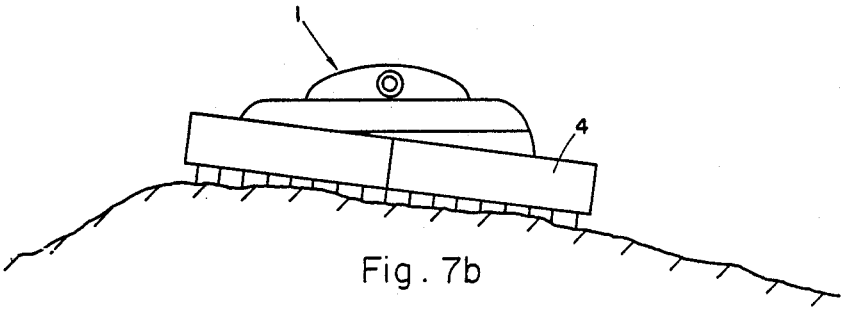
Figure 7C:
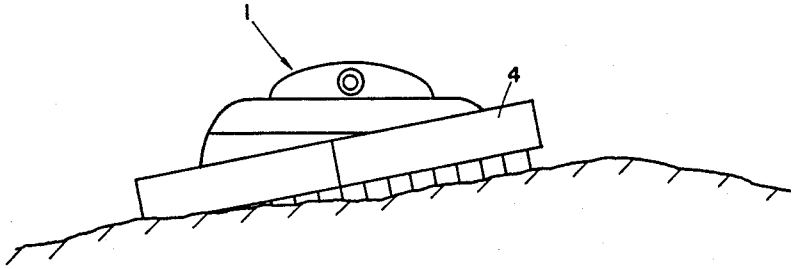

Tilting of blade 4 is shown in FIG. 7. For the performance of a tilt, one of the two actuators 14 is caused to pull while the other one is caused to push and in this way blade 4 may be tilted out of the horizontal position shown in FIG. *7a* into either of the two oblique positions shown in FIGS. *7b* and *7c* so as to adjust to a sloping terrain and thereby to ensure that a desired penetration depth of teeth 42 is maintained. A tilt of blade 4 is also accompanied by a passive movement of actuators 13, one of which is caused to retract while the other is caused to extend. These changes in the actuators 13 are however, of a passive nature the prime movers for tilting being exclusively actuators 14. It should further be noted that while for simplicity of illustration the elevation, oscillation and tilt of blade 4 have hereinbefore been described separately, in actual practice the depth control of teeth 42, whether manual or automatic, will as a rule involve all three movements simultaneously.

When the COV according to the invention is used in the dozer mode it operates as a normal bull-dozer. In this mode of operation the tracking system is, as a rule, not required and arms 7 with shoes 8 may be removed. On the other hand, the tracking system is required in the plough mode of blade 4, which mode serves mainly for mine clearing. During this operation the ploughed earth with the mines are thrown to the two sides of the plough leaving behind a clear lane which if desired may be marked by a mechanical clear lane marking system that can be attached to the rear of the vehicle.

A dual purpose blade of the kind hereinbefore described may also be mounted on an ordinary, non-military vehicle such as a tractor and be used in the plough mode for civil operations such as land clearing and root ploughing.

We claim:

1. An automotive earth moving vehicle, comprising, in combination, a frame, push beams articulatingly mounted upon said frame, a blade articulatingly coupled to said push beams, a first set of fluid driven actuators, each articulatingly coupled to said frame and to said blade, for lifting and lowering said blade, a second set of fluid driven actuators, each articulatingly coupled to respective push beams and to said blade, for oscillating and tilting said blade, a cross-member coupled to a rear side of said blade and upon which said push beams and said first and second sets of actuators are articulatingly mounted, wherein said blade comprises two segments hingedly linked to one another to alternate between a substantially straight shape or dozer mode and angular shape or plough mode, and additionally comprising means for securing said segments in one of said modes and comprising two lugs, each mounted on a rear edge of a respective one of said segments, a pair of legs mounted on opposite ends of said cross-member, and a pair of links, each linking a respective one of said lugs and a respective one of said legs.

2. A vehicle according to claim 1 wherein the number of actuators in each of said sets is the same.

3. A vehicle according to claim 2 wherein each of said actuator sets comprises two actuators.

4. A vehicle according to claim 1, wherein a lower edge of said segments is fitted with teeth adapted to penetrate into ground, and edge guards are provided for covering the teeth from below when the blade is used in the dozer mode.

5. A vehicle according to claim 1, wherein two wing members are provided with teeth at their lower edges for attachment to the two segments of the blade in the plough mode and to flank the same.

6. The vehicle of claim 5, additionally comprising a pair of connector pieces, with a respective one of said wing members being rigidly attached to a respective one of said segments through a respective one of said connector pieces

7. A vehicle according to claim 1, comprising a control for blade movements sensor means located in front of the blade for use in the plough mode for feeding the blade movement control with data on terrain , said blade movement control also constituting means for controlling penetration depth of the blade in the terrain.

8. A vehicle according to claim 7 wherein a lower edge of said blade is fitted with teeth and said sensor means form part of a closed loop servo system for automatic manipulation of the blade such that the penetration depth of the teeth is automatically controlled.

9. A vehicle according to claim 7 wherein said sensor means are of the tactile type.

10. A vehicle according to claim 9 wherein said sensor means are ultrasonic.

11. The vehicle of claim 7, additionally comprising a plurality of arms mounted upon said blade to extend forwardly therefrom and on which said sensor means are mounted.

12. The combination of claim 1, wherein said first and second sets each comprise an even number of actuators arranged substantially symmetrically with respect to a vertical median plane of said blade, said actuators of each said set being arranged in substantially parallel spatial orientation, and said first and second sets of actuators being arranged in intersecting spatial relationship at all operational positions of said blade.

13. The combination of claim 1, comprising two and only two sets of actuators.

14. The combination of claim 1, additionally comprising a bracing bar articulatingly coupled to said cross-member and to one of said push beams, for reinforcing support of said blade in operating position.

15. A vehicle according to claim 1, comprising a control for blade movements sensor means located in front of the blade for use in the plough mode for feeding the blade movement control with data on terrain.

16. A vehicle according to claim 15, wherein a lower edge of said segments is fitted with teeth and said sensor means form part of a closed loop servo system for automatic manipulation of the blade such that the penetration depth of said teeth is automatically controlled.

17. A vehicle according to claim 1, wherein the actuators are hydraulic.

18. The vehicle of claim 1, wherein the actuators of each said set are of substantially parallel spatial orientation, while said first and second sets are in intersecting spatial relationship with respect to each other which is maintained at all operational positions of the blade.

* * * * *